US008844634B2

(12) United States Patent
Clausen et al.

(10) Patent No.: US 8,844,634 B2
(45) Date of Patent: Sep. 30, 2014

(54) CIRCULATION SUB WITH INDEXING MECHANISM

(75) Inventors: Jeffery Ronald Clausen, Houston, TX (US); Nicholas Ryan Marchand, Edmonton, CA (US)

(73) Assignee: National Oilwell Varco, L.P., Houston, TX (US)

( * ) Notice: Subject to any disclaimer, the term of this patent is extended or adjusted under 35 U.S.C. 154(b) by 457 days.

(21) Appl. No.: 12/743,670

(22) PCT Filed: Nov. 19, 2008

(86) PCT No.: PCT/US2008/083986

§ 371 (c)(1),
(2), (4) Date: May 19, 2010

(87) PCT Pub. No.: WO2009/067485

PCT Pub. Date: May 28, 2009

(65) Prior Publication Data

US 2010/0252276 A1 Oct. 7, 2010

Related U.S. Application Data

(60) Provisional application No. 60/989,345, filed on Nov. 20, 2007.

(51) Int. Cl.

| | |
|---|---|
| ***E21B 34/14*** | (2006.01) |
| ***E21B 23/00*** | (2006.01) |
| ***E21B 21/10*** | (2006.01) |

(52) U.S. Cl.

CPC ..... *E21B 23/006* (2013.01); *E21B 21/103* (2013.01)

USPC ..... 166/373; 166/386; 166/318; 166/319; 166/331; 166/238

(58) Field of Classification Search

USPC ..... 166/373, 381, 386, 318, 319, 330, 331, 166/237, 238, 154

See application file for complete search history.

(56) References Cited

U.S. PATENT DOCUMENTS

| | | | |
|---|---|---|---|
| 4,256,179 | A | 3/1981 | Shillander |
| 4,298,077 | A | 11/1981 | Emery |

(Continued)

FOREIGN PATENT DOCUMENTS

| | | | |
|---|---|---|---|
| CA | 2630916 | A1 | 5/2007 |
| EP | 0787888 | B1 | 3/2005 |

(Continued)

OTHER PUBLICATIONS

Canadian Office Action dated Nov. 2, 2011; Canadian Application No. 2,705,295 (2 p.).

(Continued)

*Primary Examiner* — Jennifer H Gay
(74) *Attorney, Agent, or Firm* — Conley Rose, P.C.

(57) ABSTRACT

A downhole circulation sub or valve includes a tubular housing with an outer port and a valve piston slidably disposed in the housing. A primary fluid flow path extends through an inner flow bore of the housing and valve piston. In a first position, the valve piston isolates the outer port to prevent fluid communication between the inner flow bore and a well bore annulus. In a second position, the valve piston is moved to obstruct the inner flow bore and expose the outer port to the inner flow bore and allow fluid communication between the inner flow bore and the well bore annulus. An indexing mechanism is coupled between the housing and the valve piston to guide the valve piston between the first and second positions. The indexing mechanism may include a rotatable component.

26 Claims, 13 Drawing Sheets

(56) References Cited

U.S. PATENT DOCUMENTS

| | | | | |
|---|---|---|---|---|
| 4,403,659 | A * | 9/1983 | Upchurch | 166/374 |
| 4,406,335 | A | 9/1983 | Koot | |
| 4,632,187 | A | 12/1986 | Deaton | |
| 5,421,420 | A | 6/1995 | Malone et al. | |
| 5,443,129 | A | 8/1995 | Bailey et al. | |
| 5,465,787 | A | 11/1995 | Roth | |
| 5,609,178 | A * | 3/1997 | Hennig et al. | 137/10 |
| 5,787,981 | A | 8/1998 | Taylor | |
| 5,901,796 | A | 5/1999 | McDonald | |
| 6,095,249 | A | 8/2000 | McGarian et al. | |
| 6,220,357 | B1 | 4/2001 | Carmichael et al. | |
| 6,253,861 | B1 * | 7/2001 | Carmichael et al. | 175/237 |
| 6,263,969 | B1 | 7/2001 | Stoesz et al. | |
| 6,349,763 | B1 | 2/2002 | Estep et al. | |
| 6,467,547 | B2 * | 10/2002 | Maguire et al. | 166/386 |
| 6,609,569 | B2 * | 8/2003 | Howlett et al. | 166/264 |
| 6,634,424 | B2 | 10/2003 | Knowles | |
| 6,681,858 | B2 | 1/2004 | Streater | |
| 6,820,697 | B1 | 11/2004 | Churchill | |
| 6,868,906 | B1 | 3/2005 | Vail, III et al. | |
| 6,899,179 | B2 | 5/2005 | McGarian et al. | |
| 7,055,605 | B2 | 6/2006 | Howlett et al. | |
| 7,114,581 | B2 | 10/2006 | Aronstam et al. | |
| 7,252,152 | B2 | 8/2007 | LoGiudice et al. | |
| 7,303,022 | B2 | 12/2007 | Tilton et al. | |
| 7,337,847 | B2 | 3/2008 | McGarian et al. | |
| 7,337,850 | B2 | 3/2008 | Contant | |
| 7,357,197 | B2 | 4/2008 | Schultz et al. | |
| 7,523,792 | B2 | 4/2009 | El-Rayes et al. | |
| 7,628,213 | B2 * | 12/2009 | Telfer | 166/381 |
| 7,640,991 | B2 | 1/2010 | Leising | |
| 7,644,766 | B2 * | 1/2010 | Begley et al. | 166/312 |
| 7,661,478 | B2 | 2/2010 | Palmer et al. | |
| 7,766,084 | B2 * | 8/2010 | Churchill | 166/320 |
| 7,870,908 | B2 * | 1/2011 | Mandrou | 166/386 |
| 2002/0070032 | A1 * | 6/2002 | Maguire et al. | 166/381 |
| 2002/0144842 | A1 | 10/2002 | Schultz et al. | |
| 2004/0099447 | A1 | 5/2004 | Howlett et al. | |
| 2004/0206548 | A1 | 10/2004 | Aronstam et al. | |
| 2004/0262013 | A1 | 12/2004 | Tilton et al. | |
| 2005/0205262 | A1 | 9/2005 | Reimert et al. | |
| 2005/0217864 | A1 | 10/2005 | Carmichael | |
| 2005/0230119 | A1 | 10/2005 | McGarian et al. | |
| 2006/0225926 | A1 | 10/2006 | Madhaven et al. | |
| 2006/0243493 | A1 | 11/2006 | El-Rayes et al. | |
| 2007/0045006 | A1 | 3/2007 | Krueger et al. | |
| 2007/0056745 | A1 | 3/2007 | Contant | |
| 2007/0151737 | A1 * | 7/2007 | Begley et al. | 166/317 |
| 2007/0295514 | A1 * | 12/2007 | Rohde et al. | 166/386 |
| 2008/0029306 | A1 | 2/2008 | Krueger et al. | |
| 2008/0087470 | A1 | 4/2008 | Villareal et al. | |
| 2010/0193196 | A1 * | 8/2010 | McGarian | 166/373 |
| 2010/0252276 | A1 * | 10/2010 | Clausen et al. | 166/381 |
| 2010/0270034 | A1 * | 10/2010 | Clausen | 166/383 |
| 2011/0048723 | A1 * | 3/2011 | Edwards | 166/319 |
| 2012/0043093 | A1 * | 2/2012 | Cravatte | 166/376 |

FOREIGN PATENT DOCUMENTS

| | | | |
|---|---|---|---|
| GB | 2054008 | A | 2/1981 |
| GB | 2309470 | A | 7/1997 |
| WO | 9630621 | | 10/1996 |
| WO | 2004038170 | A1 | 5/2004 |
| WO | 2004088091 | A1 | 10/2004 |
| WO | 2004097165 | A1 | 11/2004 |
| WO | WO 2004097165 | A1 * | 11/2004 |
| WO | 2006119008 | A2 | 11/2006 |
| WO | 2009024753 | A1 | 2/2009 |

OTHER PUBLICATIONS

International Application No. PCT/US2008/083986 Search Report and Written Opinion dated Jul. 16, 2009.

International Application No. PCT/US2008/084177 Search Report and Written Opinion dated May 21, 2009.

U.K. Examination Report dated Apr. 12, 2012; Application No. GB1008271.7 (2 p.).

Canadian Office Action dated Sep. 5, 2012; Canadian Patent Application No. 2,705,295.

Canadian Office Action dated Jun. 27, 2013; Canadian Patent Application No. 2,705,295.

Canadian Office Action dated Mar. 31, 2014; Canadian Patent Application No. 2,705,295.

May 3, 2013, Summary of Mexican Office Action; Mexican Patent Application No. MX/a/2010/005598.

Sep. 17, 2013, Summary of Mexican Office Action; Mexican Patent Application No. MX/a/2010/005598.

Mar. 27, 2014, Summary of Mexican Office Action; Mexican Patent Application No. MX/a/2010/005598.

* cited by examiner

CIRCULATION SUB WITH INDEXING MECHANISM

CROSS-REFERENCE TO RELATED APPLICATIONS

This application is the U.S. National Stage Under 35 U.S.C.§371 of International Patent Application No. PCTUS2008/083986 filed Nov. 19, 2008, which claims the benefit of U.S. Provisional Patent Application No. 60/989,345, filed Nov. 20, 2007, titled "Circulation Sub With Indexing Slot."

STATEMENT REGARDING FEDERALLY SPONSORED RESEARCH OR DEVELOPMENT

Not applicable.

BACKGROUND

The present disclosure relates generally to an apparatus and method for selectively circulating fluid in a well bore. More particularly, the present disclosure relates to a selectively and continually actuatable circulation sub or valve and its method of use in well bore operations, including drilling, completion, workover, well clean out, fishing and packer setting.

When drilling an oil or gas well, a starter hole is first drilled, and the drilling rig then installed over the starter hole. Drill pipe is coupled to a bottom hole assembly, which typically includes a drill bit, drill collars, stabilizers, reamers and other assorted subs, to form a drill string. The drill string is coupled to a kelly joint and rotary table and then lowered into the starter hole. When the drill bit reaches the base of the starter hole, the rotary table is powered and drilling may commence. As drilling progresses, drilling fluid, or mud, is circulated down through the drill pipe to lubricate and cool the drill bit as well as to provide a vehicle for removal of drill cuttings from the borehole. The drilling fluid may also provide hydraulic power to a mud motor. After emerging from the drill bit, the drilling fluid flows up the borehole through the annulus formed by the drill string and the borehole, or the well bore annulus.

During drilling operations, it may be desirable to periodically interrupt the flow of drilling fluid to the bottom hole assembly and divert the drilling fluid from inside the drill string through a flow path to the annulus above the bottom hole assembly, thereby bypassing the bottom hole assembly. For example, the mud motor or drill bit in the bottom hole assembly tend to restrict allowable fluid circulation rates. Bypassing the bottom hole assembly allows a higher circulation rate to be established to the annulus. This is especially useful in applications where a higher circulation rate may be necessary to effect good cuttings transport and hole cleaning before the drill string is retrieved. After a period of time, the flow of drilling fluid to the bottom hole assembly may be reestablished. Redirecting the flow of drilling fluid in this manner is typically achieved by employing a circulation sub or valve, positioned on the drill string above the drill bit.

Typical circulation subs are limited by the number of times they can be actuated in one trip down the borehole. For example, a typical circulation sub may be selectively opened three or four times before it must be tripped out of the borehole and reset. Such a tool operates via the use of a combination of deformable drop balls and smaller hard drop balls to direct fluid flow either from the tool into the borehole annulus or through the tool. As each ball passes through the tool, a ball catcher, positioned at the downhole end of the tool, receives the ball. A drawback to this circulation sub is that the tool may be actuated via a ball drop only a limited number of times, or until the ball catcher is full. Once the ball catcher is full, the tool must be returned to the surface for unloading. After the ball catcher is emptied, the tool may be tripped back downhole for subsequent reuse. Thus, circulation of fluid in the borehole requires repeatedly returning the tool to the surface for unloading and then tripping the tool back downhole for reuse, which is both time-consuming and costly. Furthermore, such circulation subs do not adequately handle dirty fluid environments including lost circulation material, nor do they include open inner diameters for accommodating pass-through tools or obturating members.

Thus, there remains a need for a cost effective apparatus and method for selectively circulating fluid within a well bore, including continual valve actuation and reduction of valve tripping.

SUMMARY

A downhole circulation sub or valve includes a tubular housing with an outer port and a valve piston slidably disposed in the housing. A primary fluid flow path extends through an inner flow bore of the housing and valve piston. In a first position, the valve piston isolates the outer port to prevent fluid communication between the inner flow bore and a well bore annulus. In a second position, the valve piston is moved to obstruct the inner flow bore and expose the outer port to the inner flow bore and allow fluid communication between the inner flow bore and the well bore annulus. In some embodiments, the circulation sub is selectively configurable to include multiple flow paths, including a primary flow path through the sub, a secondary flow path around a seated ball and through the sub, and a bypass flow path wherein fluid is diverted to the well bore annulus.

In some embodiments, an indexing mechanism is coupled between the housing and the valve piston to move the valve piston between the first and second positions. In some embodiments, the indexing mechanism includes a rotatable component. In certain embodiments, the rotatable component of the indexing mechanism rotates independently of both the housing and the valve piston. In some embodiments, the indexing mechanism can be used to continually move the valve piston between the first and second positions in a single trip into a well bore. In some embodiments, the valve piston and indexing mechanism are powered by manipulating fluid pressures in the circulation sub.

BRIEF DESCRIPTION OF THE DRAWINGS

For a more detailed description of the disclosed embodiments, reference will now be made to the accompanying drawings, wherein.

DETAILED DESCRIPTION OF THE PREFERRED EMBODIMENTS

Figure 1:
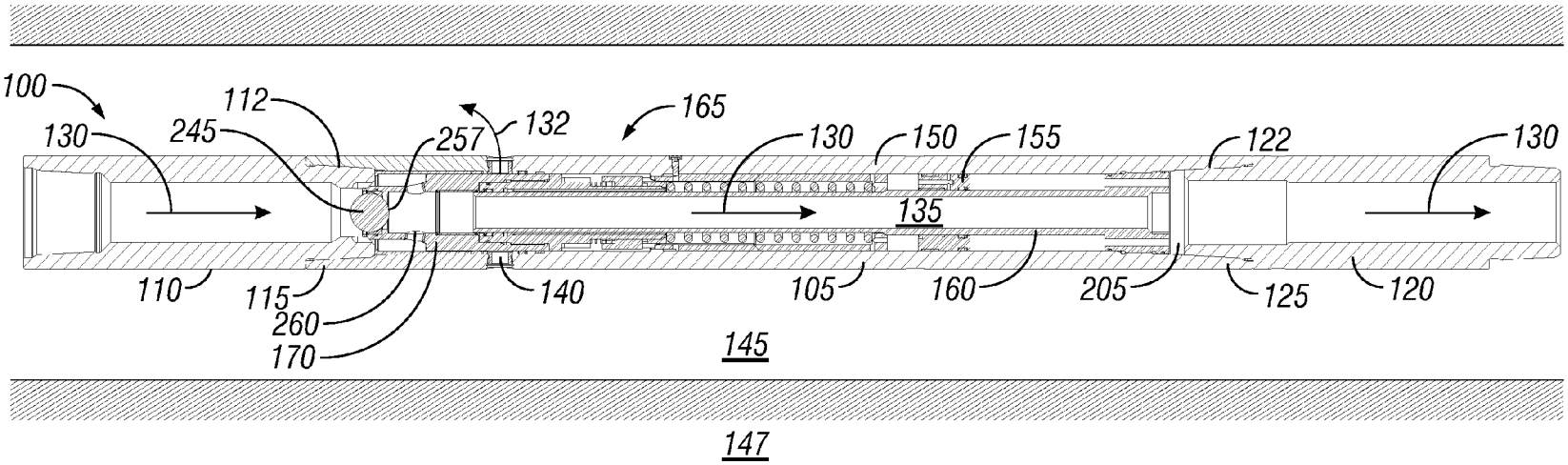
FIG. 1 schematically depicts a cross-section of an exemplary drill string portion in which the various embodiments of a circulation sub in accordance with the principles disclosed herein may be used.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

FIG. 1 schematically depicts an exemplary drill string portion, one of many in which a circulation sub or valve and associated methods disclosed herein may be employed. Furthermore, other conveyances are contemplated by the present disclosure, such as those used in completion or workover operations. A drill string is used for ease in detailing the various embodiments disclosed herein. A drill string portion 100 includes a circulation sub 105 coupled to a top sub 110 at its upper end 115 and to a bottom sub 120 at its lower end 125. As will be described herein, the sub 105 is selectively and continually actuatable, thus can also be referred to as a multi-opening circulation sub, or MOCS. The MOCS 105 includes a flowbore 135. The coupling of top sub 110 and bottom sub 120 to MOCS 105 establishes a primary fluid flow path 130 that also fluidicly couples to the fluid flow path in the drill string 100.

As will be described in detail below, the MOCS 105 is selectively configurable to permit fluid flow along one of multiple paths. In a first or "run-in" configuration, fluid flows along the path 130 from the top sub 110 through the MOCS 105 via flowbore 135 to the bottom sub 120 and other components that may be positioned downhole of the bottom sub 120, such as a drill bit. Alternatively, when the MOCS 105 assumes a second or "through-tool" configuration, fluid flows along the path 130 in the top sub 110, around a ball 245 and through ports 260, and finally back to the flowbore 135 to rejoin the path 130 to the bottom sub 120 and other lower components. In a further alternative position, when the MOCS 105 assumes a third or "bypass" configuration, fluid is diverted from the path 130 through a flow path 132 in the MOCS 105 to the well bore annulus 145, located between the drill string portion 100 and the surrounding formation 147. In some embodiments, the diversion flow path through the MOCS 105 is achieved via one or more ports 140. Once in the well bore annulus 145, the fluid returns to the surface, bypassing the bottom sub 120 and other components which may be positioned downhole of the bottom sub 120. An indexing mechanism 165 guides the MOCS 105 between these various configurations or positions.

Figure 2:
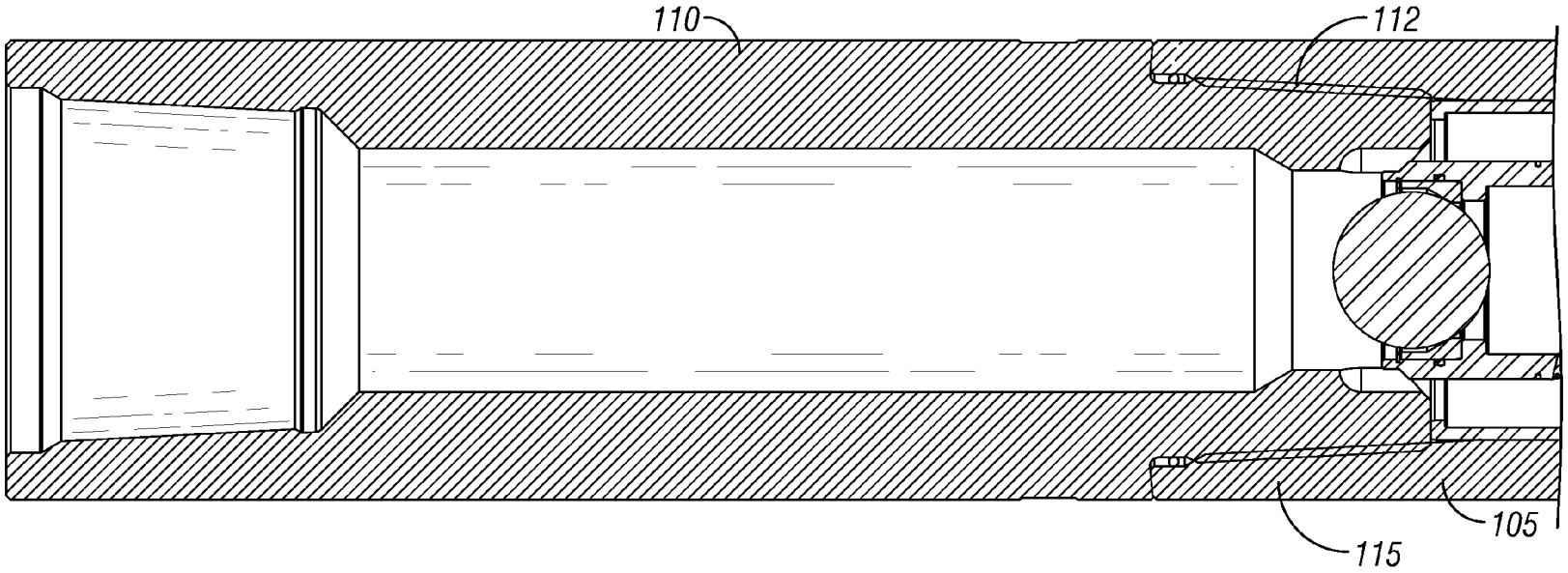
FIG. 2 is an enlarged view of the coupling between the top sub and the circulation sub shown in FIG. 1.

FIG. 2 is an enlarged view of the coupling between the top sub 110 and the MOCS 105 shown in FIG. 1. As shown, the top sub 110 and the upper end 115 of MOCS 105 are coupled via a threaded connection 112. In alternative embodiments, the components 110, 105 may be coupled by other means known in the industry.

Figure 3:
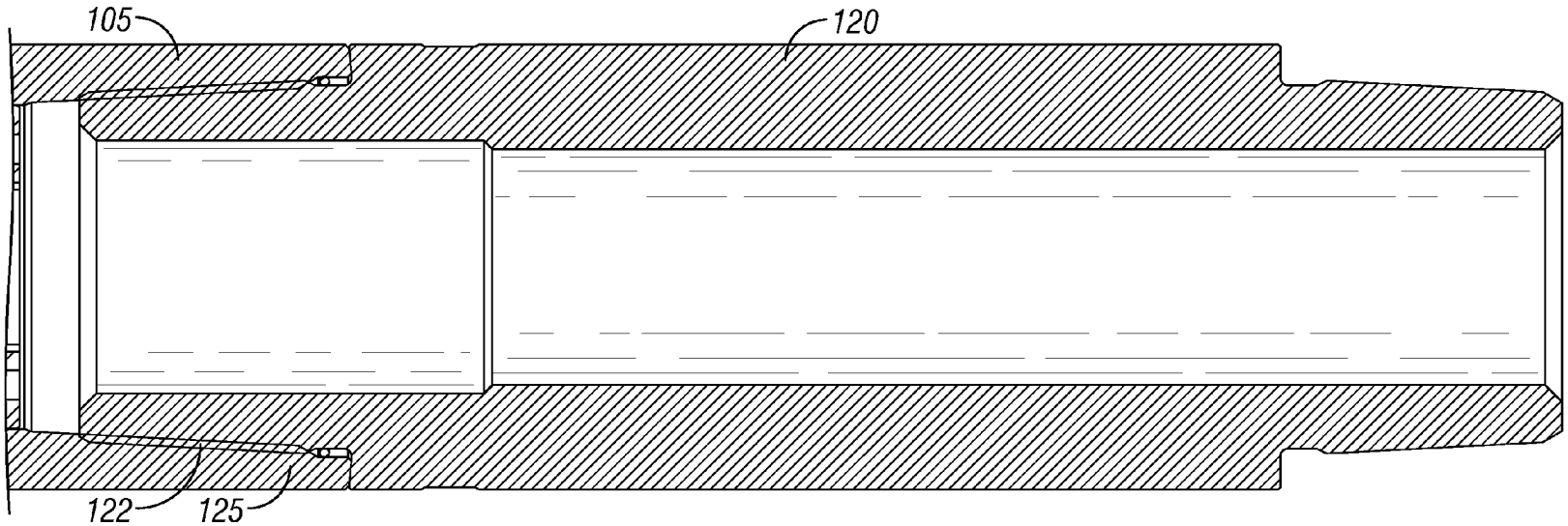
FIG. 3 is an enlarged view of the coupling between the circulation sub and the bottom sub shown in FIG. 1.

Similarly, FIG. 3 is an enlarged view of the coupling between the MOCS 105 and the bottom sub 120 shown in FIG. 1. As shown, the bottom sub 120 and the lower end 125 of MOCS 105 are coupled via a threaded connection 122. In alternative embodiments, the components 120, 105 may be coupled by other means known in the industry.

Figure 4:
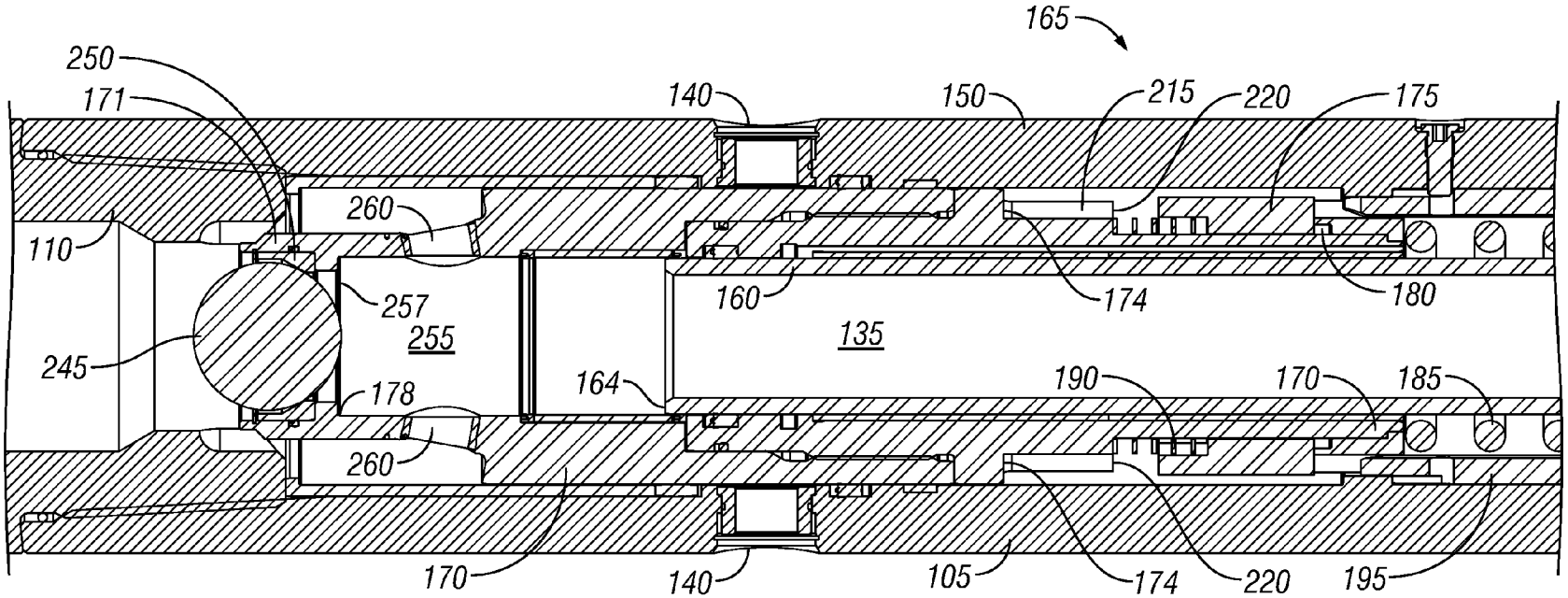
FIG. 4 is an enlarged view of the upper portion of the circulation sub shown in FIG. 1.
Figure 5:
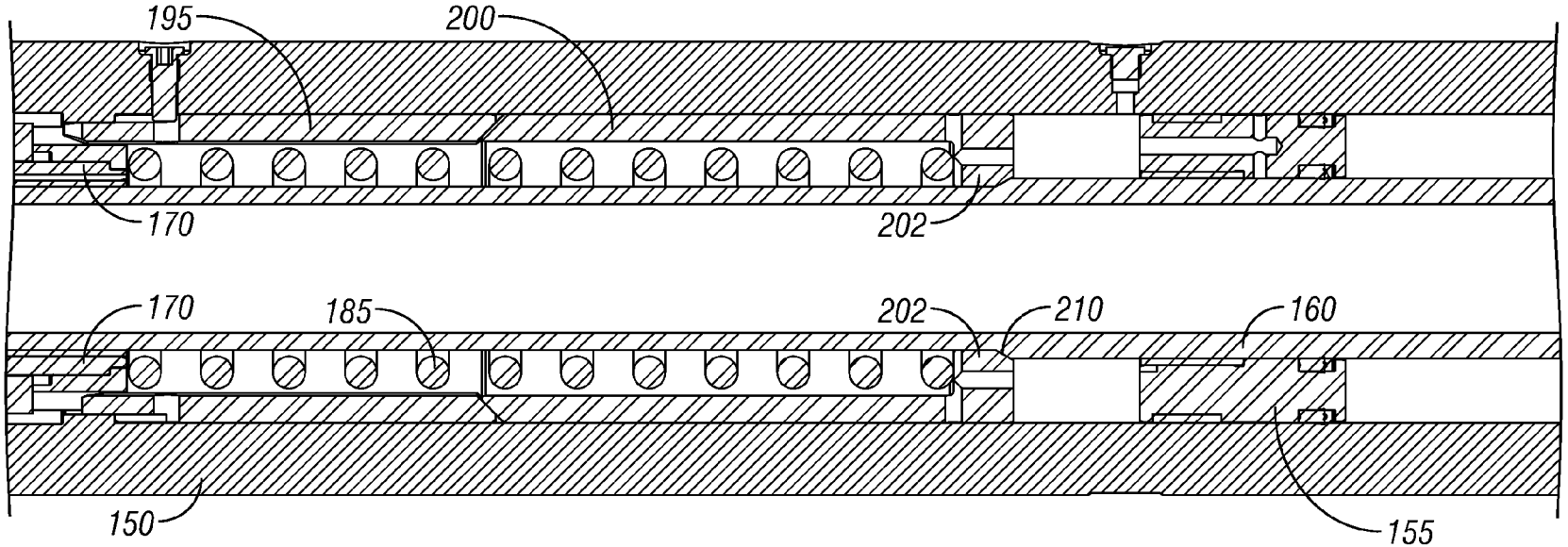
FIG. 5 is an enlarged view of the middle portion of the circulation sub shown in FIG. 1.
Figure 6:
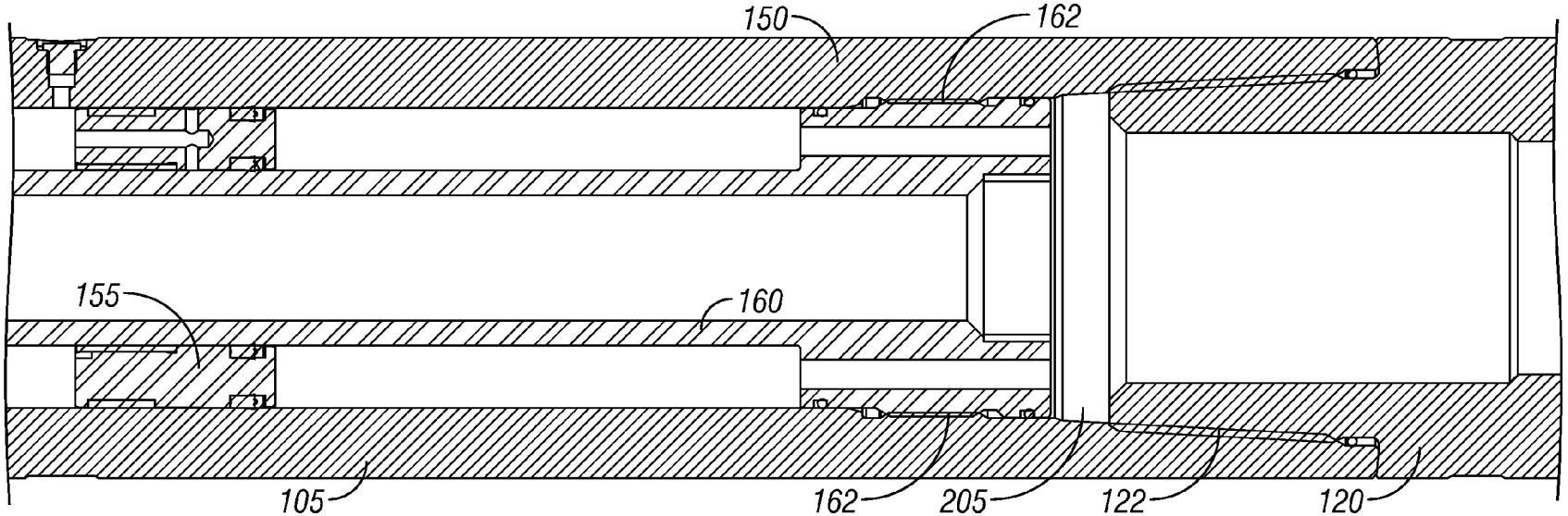
FIG. 6 is an enlarged view of the lower portion of the circulation sub shown in FIG. 1.

Returning to FIG. 1, the details of the MOCS 105 will be described with additional reference to enlarged views of the upper, middle and lower portions of the MOCS 105 as depicted in FIGS. 4, 5 and 6, respectively. Referring first to FIG. 1, the MOCS 105 includes a valve body or housing 150, a floater piston 155, a valve mandrel 160, an indexing mechanism 165 and a ported valve piston 170 slidably disposed in the housing 150. The valve body 150 of the MOCS 105 couples to the top sub 110 via threaded connection 112 and to bottom sub 120 via threaded connection 122, as described above in reference to FIGS. 2 and 3. Proceeding from the uphole end 115 to the downhole end 125 of the MOCS 105, the ported valve piston 170, the indexer 165 and the floater piston 155 are positioned concentrically within the valve body 150. The valve mandrel 160 is positioned concentrically within the ported valve piston 170, the indexer 165 and the floater piston 155 between the top sub 110 and the bottom sub 120. In some embodiments, the valve mandrel 160, the ported valve piston 170 and other similarly represented components in the figures are cylindrical, hollow members or sleeves.

The indexer 165 includes multiple interrelated components, the combination of which enables the MOCS 105 to be selectively configured to allow fluid flow through the MOCS 105 along the path 130 or to divert fluid flow from the MOCS 105 along the path 132. As will be described further herein, selective actuation between multiple configurations and flow paths is achieved continually during one trip down the borehole, and is not limited to a predetermined number of actuations. Referring briefly to FIGS. 4, 5 and 6, the indexer 165 includes an index ring 175, index teeth ring 180, a large spring 185, a small spring 190, a spline sleeve 195 and a spline spacer 200. The spline sleeve 195 is coupled to the inside of the housing 150 so that it is rotationally and axially fixed relative to the housing 150. The index ring 175 is rotationally and axially moveable relative to the housing 150 and the piston 170, with the small spring 190 biasing the index ring 175 toward the spline sleeve 195. The large spring 185 provides an upward biasing force on the piston 170. Further relationships and operation of the indexer 165 are described below.

Figure 7:
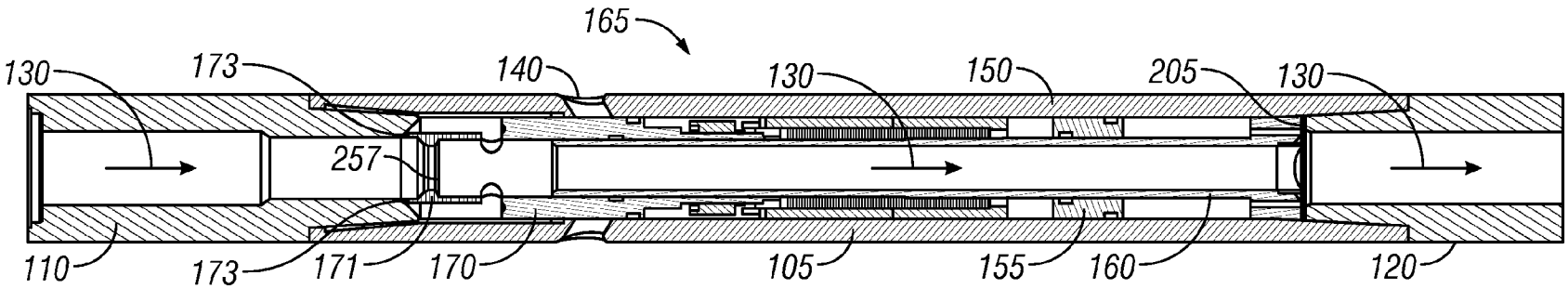
FIG. 7 depicts the circulation sub of FIG. 1 in a run-in configuration.
Figure 8:
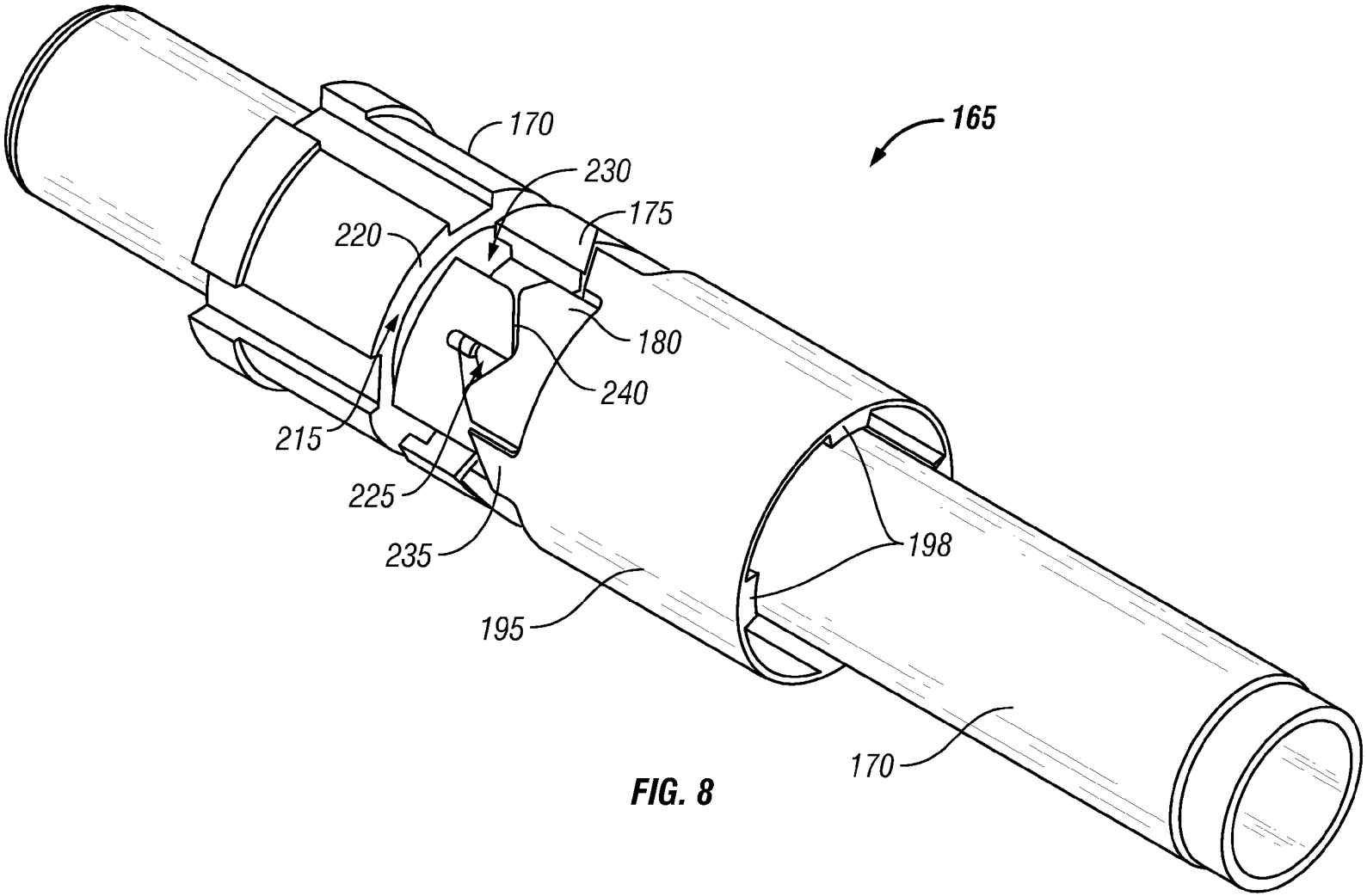
FIG. 8 is a perspective view of an indexer of the circulation sub of FIG. 7 in a run-in configuration.
Figure 9:
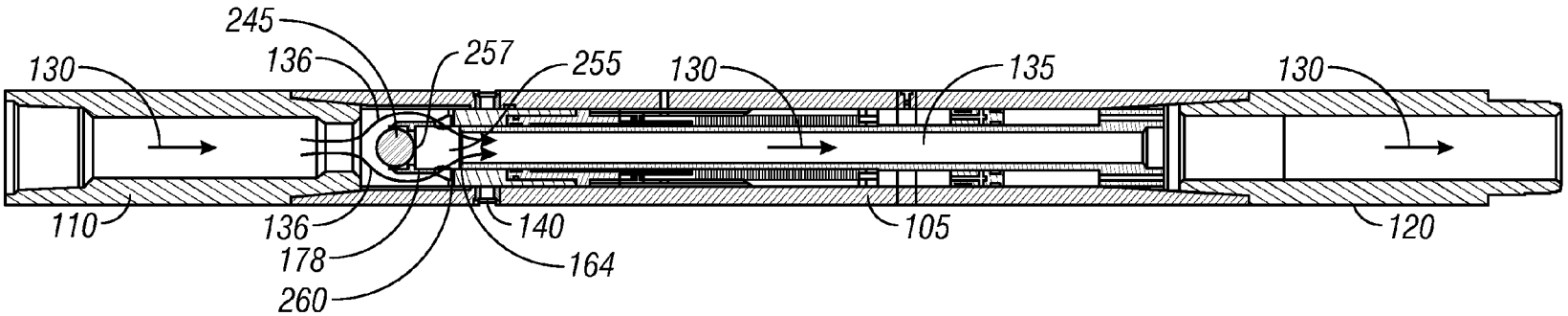
FIG. 9 depicts the circulation sub of FIG. 1 in a through-tool configuration.
Figure 10:
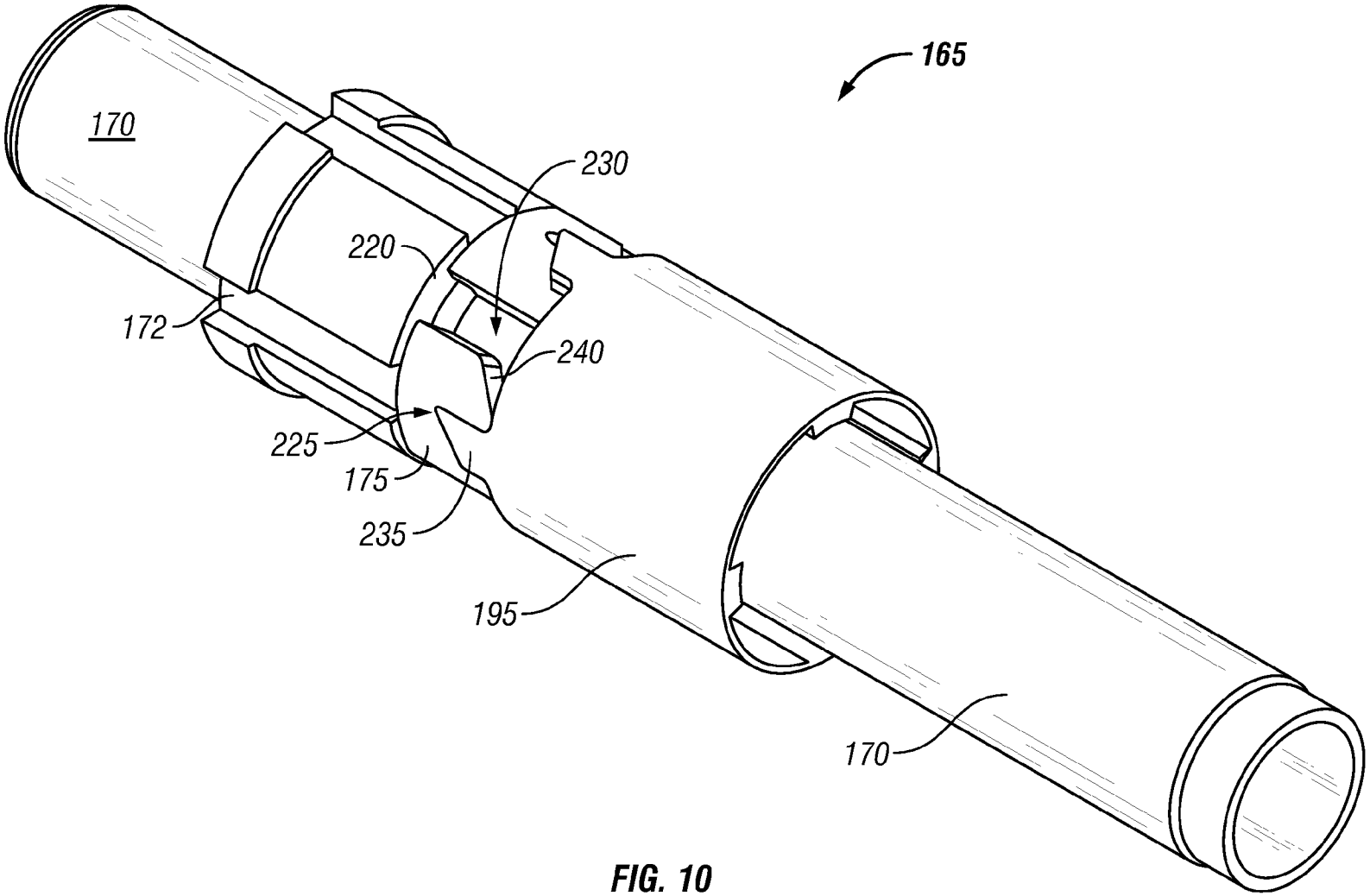
FIG. 10 is a perspective view of the indexer of the circulation sub of FIG. 9 in a through-tool configuration.
Figure 11:
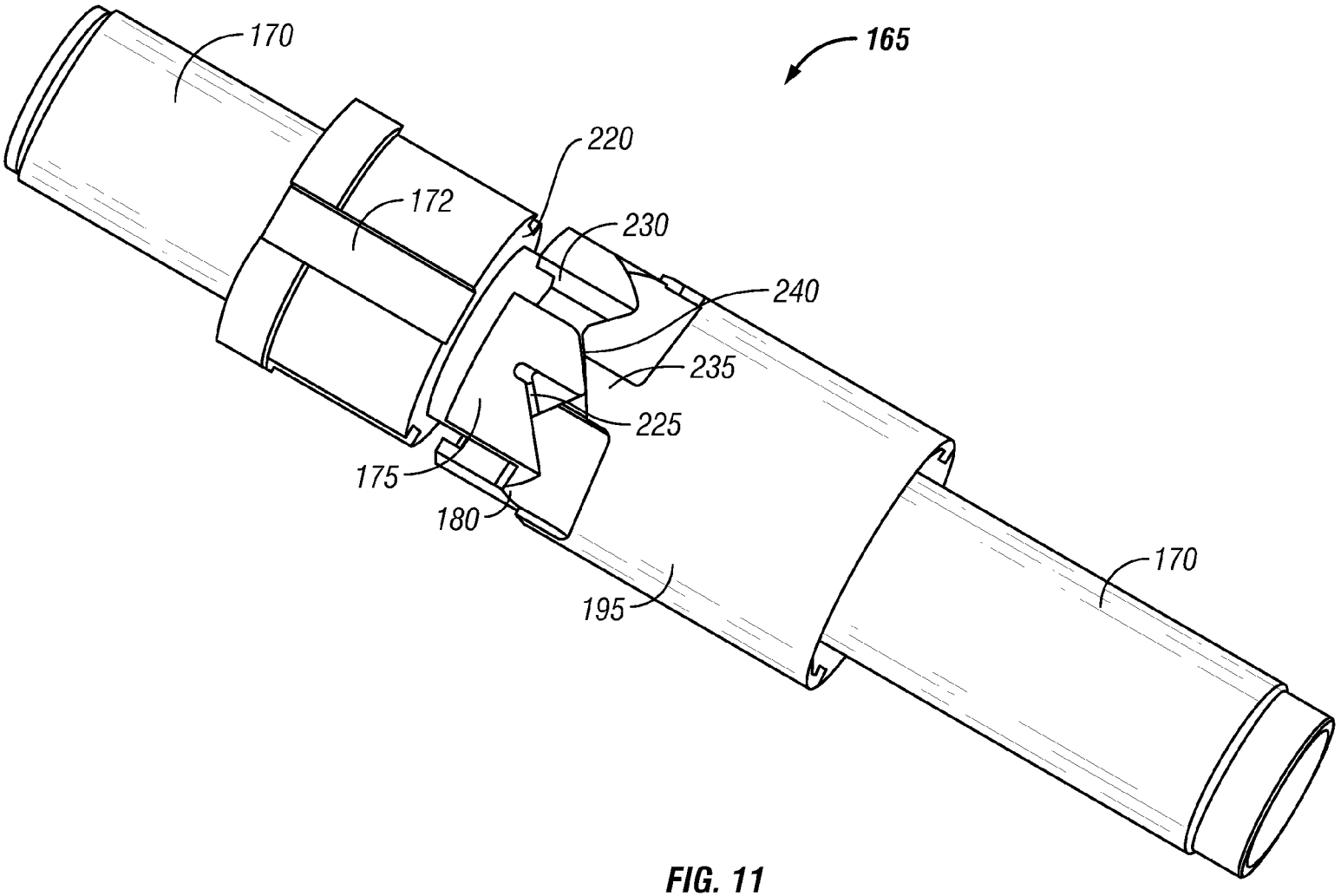
FIG. 11 is a perspective view of the indexer of FIG. 10 in a reset position.
Figure 12:
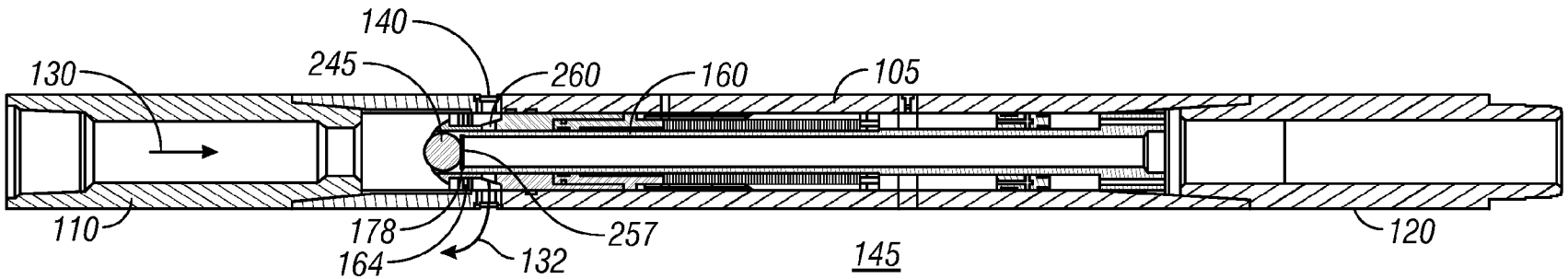
FIG. 12 depicts the circulation sub of FIG. 1 in a bypass configuration.
Figure 13:
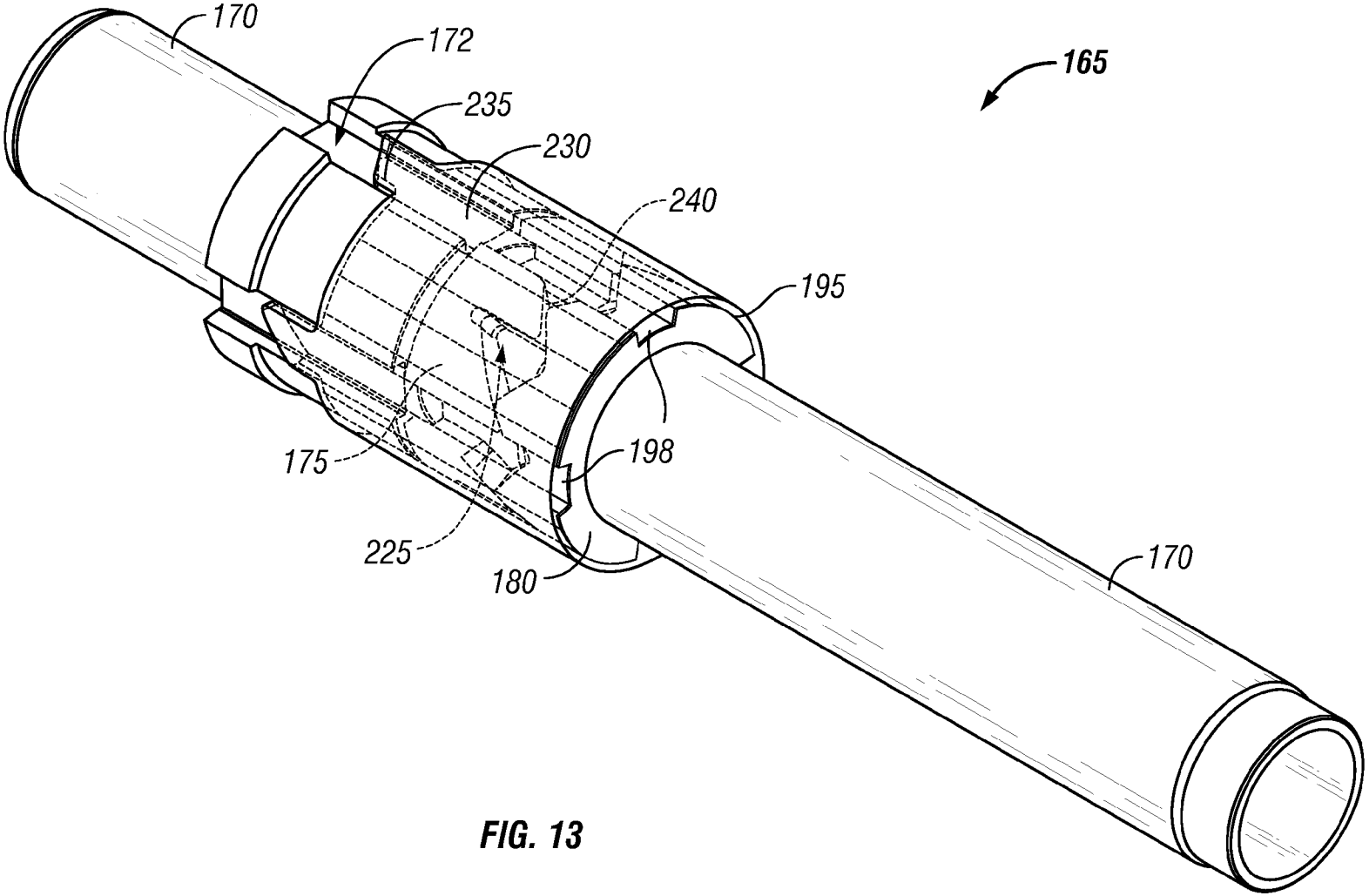
FIG. 13 is a perspective view of the indexer of the circulation sub of FIG. 12 in a bypass configuration.

The manner in which the components of the MOCS 105 move relative to each other is best understood by considering the various configurations that the MOCS 105 can assume. In the embodiments illustrated by FIGS. 1 through 13, there are multiple configurations that the MOCS 105 can assume to execute multiple flow paths: the run-in configuration, the through-tool configuration, and the bypass configuration. The run-in configuration refers to the configuration of the MOCS 105 as it is tripped downhole and allows drilling fluid to flow along the path 130, as illustrated by FIGS. 7 and 8. The through-tool configuration of the MOCS 105 allows drilling fluid to continue flowing along the path 130, with only a slight deviation around the obturating member 245 and through the ports 260. This flow path is illustrated in FIGS. 9 and 10. The bypass configuration of the MOCS 105 diverts drilling fluid from the path 130 in upper sub 110 to the well bore annulus 145 via the path 132 through the ports 140. The bypass configuration of the MOCS 105 is illustrated by FIGS. 12 and 13.

FIG. 7 depicts the MOCS 105 in the initial run-in configuration. In this configuration, the valve mandrel 160 is positioned between the ported valve piston 170 and the bottom sub 120 with a small amount of clearance 205, visible in FIGS. 1, 6 and 7, between the valve mandrel 160 and the bottom sub 120. The upper portion 171 of the valve piston 170 is shouldered at 173 while the body of the valve piston 170 blocks or isolates the annulus ports 140, thereby providing an unencumbered primary flow path 130 through the tool. When the MOCS 105 is tripped downhole, the indexer 165 also assumes an initial run-in configuration, as depicted in FIG. 8.

Referring now to FIG. 8, the index ring 175, the index teeth ring 180, and the spline sleeve 195 are positioned concentrically about the ported valve piston 170 with a clearance 215 between a shoulder 220 of the ported valve piston 170 and the index ring 175. The index ring 175 includes one or more short slots 225 distributed about its circumference. The index ring 175 also includes one or more long slots 230 distributed about its circumference in alternating positions with the short slots 225. Between each short slot 225 and each long slot 230, the lower end 240 of the index ring 175 is angular to form a cam surface. The index ring 175 may also be referred to as an indexing slot.

The spline sleeve 195 includes a plurality of angled tabs 235 extending from an upper end of the spline sleeve 195, with corresponding splines 198 extending along the inner surface of the spline sleeve 195. Each tab 235 and spline 198 of spline sleeve 195 is sized to fit into each short slot 225 and each long slot 230 of the index ring 175. When the indexer 165 assumes the run-in configuration, as shown in FIG. 8, each tab 235 is engaged with an angular surface 240 between the short slots 225 and long slots 230 to form mating cam surfaces between the spline sleeve 195 and the index ring 175.

After the MOCS 105 is positioned downhole in the run-in configuration, it may become desirable to divert the fluid flow 130 to the annulus 145. First, the MOCS 105 must be actuated. Referring again to FIG. 1, a ball 245 is dropped or released into the drill string coupled to the top sub 110 of the tool 100. The ball 245 is carried by drilling fluid along the drill string through the top sub 110 to the MOCS 105 where, referring now to FIG. 4, the ball 245 lands in a ball seat 250 in the upper end 171 of the ported valve piston 170. Once seated, the ball 245 obstructs the flow of drilling fluid through inlet 257 of the ported valve piston 170 and provides a pressure differential that actuates the MOCS 105. Although the ball 245 is employed to actuate the MOCS 105 in this exemplary embodiment, other obturating members known in the industry, for example, a dart, may be alternatively used to actuate the MOCS 105.

Referring now to FIG. 5, in response to the pressure load from the now-obstructed drilling fluid flow, the ported valve piston 170 translates downward, compressing the larger spring 185 against spline spacer sleeve 200 at a shoulder 202. The spline spacer sleeve 200 abuts a shoulder 210 of the valve mandrel 160. Thus, the compression load from the ported valve piston 170 is transferred through the larger spring 185 and the spline spacer sleeve 200 to the valve mandrel 160, which is threaded into the valve body 150 at 162 above the clearance 205, as shown in FIG. 6. The valve mandrel 160, connected at the threads 162, is torqued up and does not move further during operation of the MOCS 105.

Continued translation of the ported valve piston 170 downward under pressure load from the drilling fluid also compresses the small spring 190 (FIG. 4) against the index ring 175 and eventually closes the clearance 215 (FIG. 8) between the shoulder 220 of the ported valve piston 170 and the index ring 175. Referring to FIG. 8, once the clearance 215 is closed and the shoulder 220 of the ported valve piston 170 abuts the index ring 175, continued translation of the ported valve piston 170 downward causes the lower angular surfaces 240 of the index ring 175 to slide along the mating angled tabs 235 of the spline sleeve 195. As the surfaces 240 slide along the angled tabs 235, the index ring 175 rotates about the ported valve piston 170 relative to the spline sleeve 195 until each tab 235 of the spline sleeve 195 fully engages an angled short slot 225 of the index ring 175. This completes actuation of the MOCS 105, as shown in FIG. 10.

Referring now to FIG. 10, once each tab 235 of the spline sleeve 195 fully engages a short slot 225 of the index ring 175, the index ring 175 is prevented from rotating and the ported valve piston 170 is prevented by the index ring 175 from translating further downward about the valve mandrel 160. This configuration of the indexer 165 corresponds to the through-tool configuration of the MOCS 105 as shown in FIG. 9. The index ring 175 is rotationally constrained by the interlocking tab 235 and slot 225 arrangement, and axially constrained by the abutting piston shoulder 220 and spline sleeve 195 (which is coupled to the body 150).

Referring now to FIG. 9, the ball 245 continues to obstruct the flow of drilling fluid through the inlet 257 of the ported valve piston 170. The downwardly shifted valve piston 170 also continues to isolate the annulus ports 140 and prevent fluid communication between the inner fluid flow 130 and the well bore annulus 145. Thus, the drilling fluid flows around the ball 245 and passes through one or more inner diameter (ID) ports 260 (see also FIG. 4) in the ported valve piston 170 to define a secondary inner flow path as shown by arrows 136. Once through the ID ports 260, the drilling fluid flows through a flowbore 255 of the ported valve piston 170 and continues along the path 130 through the flowbore 135 of the MOCS 105 to the bottom sub 120 and any components that may be positioned downhole of the bottom sub 120. Thus, with the MOCS 105 in the through-tool configuration, the drilling fluid is permitted to flow from the top sub 110 through the tool 105 and to the bottom sub 120.

When it is desired to divert all or part of the flow of drilling fluid to the bottom sub 120 and/or any components positioned downhole of the bottom sub 120, such as the mud motor or drill bit, the MOCS 105 may be selectively reconfigured from the through-tool configuration to the bypass configuration. To reconfigure the MOCS 105 in this manner, the flow of drilling fluid to the MOCS 105 is first reduced or discontinued to allow the indexer 165 to reset. The flow rate reduction of the drilling fluid removes the downward pressure load on the ported valve piston 170. In the absence of this pressure load, the large spring 185 expands, causing the index ring 175 and the ported valve piston 170 to translate upward (FIG. 4). At the same time, the absence of the pressure load also allows the small spring 190 to expand, causing the ported valve piston 170 to translate upward relative to the index ring 175 (FIG. 4). Once the small spring 190 and the large spring 185 have expanded, the indexer 165 is reset to a position shown in FIG. 11. Unlike the position shown in FIG. 8, the index ring 175 is now rotated slightly and the respective cam surfaces of the index ring end 240 and the tabs 235 are aligned to guide the spline sleeve 195 into the long slots 230 rather than the short slots 225.

After the indexer 165 is reset, the flow of drilling fluid through the drill string portion 100 and the top sub 110 to the MOCS 105 may be increased or resumed to cause the MOCS 105 and the indexer 165 to assume their bypass configurations. As before, the pressure load of the drilling fluid acting on the obstructed ported valve piston 170 causes translation of the piston 170 downward, compressing the small spring 190 (FIG. 4) against the index ring 175 and eventually closing the clearance 215 (FIG. 8) between the shoulder 220 of the ported valve piston 170 and the index ring 175.

Once the clearance 215 is closed and the shoulder 220 of the ported valve piston 170 abuts the index ring 175, continued translation of the ported valve piston 170 downward causes angled surfaces 240 of index ring 175 to slide along the angled tabs 235 of the spline sleeve 195. As the angled surfaces 240 slide along tabs 235, the index ring 175 rotates from the position shown in FIG. 11 about the piston 170 relative to the spline sleeve 195 until each tab 235 engages a long slot 230 of the index ring 175. As shown in FIG. 11, the tabs 235 are aligned with slots 172 on the valve piston 170. After each tab 235 of the spline sleeve 195 engages a long slot 230 of the index ring 175, the long slots 230 become axially aligned with the tabs 235 and the slots 172, and the index ring 175 is prevented from rotating further.

Referring now to FIG. 13, the pressure-loaded valve piston 170 continues to translate downward relative to the fixed spline sleeve 195 because the tabs 235 are aligned with the long slots 230 and the slots 172. The long slots 230 and the slots 172 are guided around the splines 198 until the valve piston 170 reaches the position in the spline sleeve 195 as shown in FIG. 13, wherein a valve piston shoulder 178 (FIGS. 4, 9 and 12) has contacted a valve mandrel shoulder 164 to bottom out the valve piston 170 on the mandrel 160. This configuration of the indexer 165 corresponds to the bypass configuration of the MOCS 105 as shown in FIG. 12.

Referring to FIG. 12, when the MOCS 105 assumes its bypass configuration, the ball 245 continues to obstruct the flow of drilling fluid through the inlet 257 of the ported valve piston 170. Furthermore, the ID ports 260 of the ported valve piston 170 have been disposed below the upper end of the valve mandrel 160 such that the valve mandrel 160 now blocks the ports 260. Simultaneously, the outer diameter (OD) ports 140 in the valve body 150 are exposed to the fluid flow around the ball 245 by the downwardly shifted valve piston 170. With the inlet 257 to the ported valve piston 170 obstructed by the ball 245 and the ports 260 blocked by the valve mandrel 160, the drilling fluid flows around the ball 245 and is diverted from the path 130 to the path 132 through the ports 140 into the well bore annulus 145, thereby bypassing the bottom sub 120 and any components that may be positioned downhole of the bottom sub 120.

To reestablish the flow of drilling fluid along the path 130 through the flowbore 135 of the MOCS 105, the drilling fluid flow is discontinued to allow the indexer 165 to reset, as described above, to the position of FIG. 8. After the indexer 165 is reset, the drilling fluid flow is then resumed to cause the indexer 165 to rotate and lock into its through-tool configuration (FIG. 10) and the MOCS 105 to assume its through-tool configuration (FIG. 9), meaning the ported valve piston 170 is translated relative to the valve mandrel 160 such that the ID ports 260 are no longer blocked by the valve mandrel 160 and the ports 140 are no longer exposed. Drilling fluid is then permitted to flow along the path 130/136 through MOCS 105 to the bottom sub 120.

After a period of time, the flow of drilling fluid may be again diverted from the path 130 through the MOCS 105 to the path 132 through ports 140 of the valve body 150 into the well bore annulus 145. Again, the drilling fluid flow is discontinued to allow the indexer 165 to reset to the position of FIG. 11. After the indexer 165 is reset, the drilling fluid is then resumed to cause the indexer 165 to rotate and lock into its bypass configuration (FIG. 13) and the MOCS 105 to assume its bypass configuration (FIG. 12), meaning the ported valve piston 170 is translated relative to the valve mandrel 160 such that the ID ports 260 are blocked by the valve mandrel 160 and the OD ports 140 in the valve body 150 are exposed. Drilling fluid is then diverted from the path 130 to the path 132 through the OD 140 ports to the well bore annulus 145.

During movements in the embodiments described herein, the index teeth ring 180 serves several purposes. In the reset positions of the indexer 165, such as in FIGS. 8 and 11, the index teeth ring 180 prevents the valve piston 170 from rotating because the splines 198 are always engaged with the slots in the index teeth ring 180 and the teeth of the index teeth ring 180 engage the angled cam surfaces of the index ring 175. Furthermore, the index teeth ring 180 shifts the index ring 175 to the next position when the index ring 175 is returned by the force from the small spring 190. In some embodiments, the index teeth ring 180 may be kept from rotating or moving axially by cap screws. An axial force applied to the index teeth ring 180 may be received by a step in the index teeth ring 180, while an opposing axial force from the large spring 185 counteracts this force and forces the index teeth ring 180 onto the valve piston 170 such that the cap screws experience little net axial force.

As described above, the MOCS 105 may be selectively configured either in its through-tool configuration or its bypass configuration by interrupting and then reestablishing the flow of drilling fluid to the MOCS 105. Moreover, the MOCS 105 may be reconfigured in this manner an unlimited number of times without the need to return the tool to the surface. This allows significant time and cost reductions for well bore operations involving the MOCS 105, as compared to those associated with operations which employ conventional circulating subs.

In the exemplary embodiments of the MOCS 105 illustrated in FIGS. 1 through 13, the MOCS 105 is configurable in either of two configurations after actuation via the indexer 165. However, in other embodiments, the MOCS 105 may assume three or more post-actuation configurations by including additional slots of differing lengths along the circumference of the index ring 175 of the indexer 165.

In the exemplary embodiments of the MOCS 105 illustrated in FIGS. 1 through 13, the MOCS 105 is configurable by the application of a pressure load from the drilling fluid. However, in other embodiments, the MOCS 105 may be configurable by mechanical means, including, for example, a wireline physically coupled to the ported valve piston 170 and configured to translate the ported valve piston 170 as needed. Alternatively, the valve piston may receive a heavy mechanical load, such as a heavy bar dropped onto the top of the valve piston. Other means for actuating the MOCS and indexer arrangement described herein are consistent with the various embodiments.

The embodiments described herein can be used in environments including fluids with lost circulation material. For example, the arrangement of the ID ports 260 and the OD ports 140 prevent any superfluous spaces from acting as stagnant flow areas for particles to collect and plug the tool. Further, in some embodiments, the indexer 165 is placed in an oil chamber. Referring to FIG. 4, an oil chamber extends from a location between the OD ports 140 and point 174 down to the floater piston 155 of FIG. 5, and surrounds the indexer 165 including the springs 185, 190. The indexer 165 is not exposed to well fluids. Consequently, the internal components of the MOCS 105 can be hydrostatically balanced as well as differential pressure balanced, allowing the MOCS 105 to only shift positions when a predetermined flow rate has been reached.

While preferred embodiments have been shown and described, modifications thereof can be made by one skilled in the art without departing from the scope or teachings herein. The embodiments described herein are exemplary only and are not limiting. Many variations and modifications of the system and apparatus are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A downhole tool for circulating fluid within a well bore comprising:

a tubular housing having an outer port;

a piston slidably disposed in the housing;

an inner flow bore extending through the housing including a primary fluid flow path extending substantially between an upstream end of the inner flow bore and a downstream end of the inner flow bore;

wherein the piston includes a first position isolating the outer port from the primary fluid flow path and a second position obstructing the primary fluid flow path and exposing the outer port to provide a bypass flow path extending substantially between the upstream end of the inner flow bore and a well bore annulus;

wherein the piston is configured to receive an obturating member to actuate the piston from the first position toward the second position; and an indexing mechanism coupled between the housing and the piston to cycle the piston between the first and second positions.

2. The downhole tool of claim 1 wherein the indexing mechanism provides continual movement of the piston between the first and second positions during a single trip into the well bore.

3. The downhole tool of claim 1 wherein the piston is moveable between the first and second positions an unlimited number of times during a single trip into the well bore.

4. The downhole tool of claim 1 wherein the indexing mechanism further includes a fixed spline sleeve and a rotatable index ring.

5. The downhole tool of claim 4 wherein the spline sleeve is fixed to the housing.

6. The downhole tool of claim 4 wherein the fixed spline sleeve includes angled tabs and inner splines slidable into alternating long slots and short slots on the rotatable index ring.

7. The downhole tool of claim 6 wherein the piston includes slots aligned with the inner splines of the spline sleeve.

8. The downhole tool of claim 7 wherein:

the index ring is disposed between the piston slots and the spline sleeve;

the short slots of the index ring engage the tabs of the spline sleeve in the first position to prevent the piston slots from engaging the inner splines; and the long slots of the index ring engage the tabs of the spline sleeve in the second position to allow the inner splines to pass over the index ring and into the piston slots.

9. The downhole tool of claim 4 wherein the indexing mechanism further includes an index teeth ring engaged with the index ring and the spline sleeve.

10. The downhole tool of claim 4 wherein the indexing mechanism further includes a biasing spring.

11. The downhole tool of claim 1 further comprising a mandrel disposed in the piston, the mandrel having an upper end disposed below an upper end of the piston in the first position, and the piston upper end including a ball seat and an inner port.

12. The downhole tool of claim 11, wherein the obturating member comprising a ball is disposed in the ball seat to obstruct the primary flow path and provide a secondary inner flow path through the inner port.

13. The downhole tool of claim 12 wherein the inner port is disposed below the mandrel upper end in the second position to obstruct the inner port and the secondary inner flow path, and expose the outer port and the bypass flow path.

14. The downhole tool of claim 11 further comprising a piston biasing spring disposed about the mandrel.

15. The downhole tool of claim 14 wherein the indexing mechanism and the piston biasing spring are disposed in a sealed oil chamber.

16. The downhole tool of claim 1, wherein the tool is configured so as to divert all or part of the fluid flow to the well bore annulus when the piston is in the second position.

17. A system for circulating fluid within a well bore comprising:

a tubular string having an inner flow bore;

a housing coupled to the tubular string, the housing including a housing port;

a piston disposed in the housing and having a primary fluid flow path;

wherein the piston is configured to receive an obturating member to obstruct the primary fluid flow path while isolating the housing port;

wherein the piston includes a secondary flow path disposed in the housing and extending around the received obturating member;

wherein the piston is selectively moveable to isolate and expose the housing port to the inner flow bore; and a rotatable indexer coupled to the piston, the rotatable indexer operable to move the piston an unlimited number of times during a single trip into the well bore;

wherein the piston includes an upper end having a seat and a piston port, the obturating member comprises a ball, wherein the seat receives the ball to obstruct the primary fluid flow path into the piston while the housing port is isolated, and wherein the piston port directs the secondary fluid flow path into the piston.

18. The system of claim 17 wherein the rotatable indexer includes:

an index ring having a set of short slots and a set of long slots; and a spline sleeve having a set of inner splines;

wherein the set of inner splines is alternately disposable in the set of short slots and the set of long slots while moving the piston.

19. The system of claim 17 further comprising an inner mandrel to obstruct the fluid flow into the piston port while the housing port is exposed and the fluid flow is directed into a well bore annulus.

20. The system of claim 19, wherein the tool is configured so as to divert all or part of the fluid flow to the well bore annulus when the housing port is exposed.

21. A method for circulating fluid within a well bore comprising:

disposing a tubular string having a circulation sub in the well bore;

flowing a fluid through a primary fluid flow path of the circulation sub;

isolating an outer port in the circulation sub with an inner piston;

obstructing the primary fluid flow path in the circulation sub while exposing the outer port to a fluid flow from upstream of the obstruction;

moving the inner piston by rotating an indexer;

exposing a downstream end of an inner flow bore of the circulation sub to a fluid flow from upstream of the obstruction while isolating the outer port;

blocking an inlet of the inner piston with the obturating member; and flowing the fluid around the obturating member and into a piston port.

22. The method of claim 21 further comprising:

blocking the piston port in response to moving the inner piston; and thereby directing the fluid flow through the outer port.

23. The method of claim 21, wherein directing the fluid flow comprises diverting all or part of the fluid flow through the outer port.

24. A method for circulating fluid within a well bore comprising:

disposing a tubular string having a circulation sub in the well bore;

flowing a fluid through the tubular string and the circulation sub;

isolating a housing port in an outer housing of the circulation sub with an inner piston;

providing an obturating member in the inner piston to obstruct a primary fluid flow path while isolating the housing port;

exposing the housing port to a fluid flow from upstream of the obturating member while obstructing the primary fluid flow path;

moving the inner piston by rotating a portion of an indexer to re-isolate the housing port and expose a downstream end of an inner flow bore of the outer housing to a fluid flow from upstream of the obturating member;

obstructing the primary fluid flow path to actuate the inner piston and the indexer;

maintaining isolation of the housing port by preventing translation of the inner piston using the indexer;

decreasing the fluid flow to translate the piston and reset the indexer;

increasing the fluid flow to translate the piston and expose the housing port; and repeating the decreasing and increasing the fluid flow steps to selectively isolate and expose the housing port any number of times during the single well bore trip.

25. The method of claim 24, wherein exposing the housing port to the fluid flow comprises exposing the housing port to all or part of the fluid flow.

26. The method of claim 24 wherein the fluid flow is increased to divert part of the fluid flow through the exposed port and part of the fluid flow through the circulation sub.

* * * * *